US006591798B2

(12) United States Patent
Hendriksma et al.

(10) Patent No.: US 6,591,798 B2
(45) Date of Patent: Jul. 15, 2003

(54) VARIABLE VALVE ACTUATION ASSEMBLY FOR AN INTERNAL COMBUSTION ENGINE

(75) Inventors: Nick J. Hendriksma, Grand Rapids, MI (US); James Neimeier, Webster, NY (US); Timothy Wilton Kunz, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/023,382

(22) Filed: Dec. 17, 2001

(65) Prior Publication Data

US 2003/0111031 A1 Jun. 19, 2003

(51) Int. Cl.[7] ..... F01L 1/34

(52) U.S. Cl. ..... 123/90.16; 123/90.31; 123/90.39; 123/90.41; 123/90.44; 74/559

(58) Field of Search ..... 123/90.15, 90.16, 123/90.17, 90.27, 90.6, 90.39, 90.4, 90.41, 90.42, 90.43, 90.44; 74/559, 567, 569

(56) References Cited

U.S. PATENT DOCUMENTS 4,151,817 A * 5/1979 Mueller ..... 123/90.16
5,445,116 A * 8/1995 Hara ..... 123/90.16
5,529,033 A * 6/1996 Hampton ..... 123/90.16
5,623,897 A 4/1997 Hampton et al.
5,653,198 A * 8/1997 Diggs ..... 123/90.16

* cited by examiner

*Primary Examiner*—Thomas Denion
*Assistant Examiner*—Ching Chang
(74) *Attorney, Agent, or Firm*—Patrick M. Griffin

(57) ABSTRACT

A variable valve actuation assembly for actuation of an engine intake valve between low-lift and high-lift modes. The VVA assembly includes a special rocker assembly having a pivotable central high-lift cam follower and two peripheral low-lift cam followers; a camshaft having low-lift and high-lift lobes engageable with the respective cam followers; a primary latching assembly including a slidable primary latching pin in the rocker assembly for engaging and disengaging the high-lift follower; a solenoid for causing the primary latching pin to be engaged and disengaged; and a secondary latching mechanism between the solenoid and the primary latching pin to automatically limit engagement and disengagement of the primary latching pin to times in the duty cycle of the camshaft (during lift events) when ejections of the primary latching pin are not possible.

18 Claims, 10 Drawing Sheets

VARIABLE VALVE ACTUATION ASSEMBLY FOR AN INTERNAL COMBUSTION ENGINE

TECHNICAL FIELD

The present invention relates to internal combustion engines; more particularly, to devices for controlling the variable actuation of intake valves in an internal combustion engine; and most particularly, to a variable valve actuation assembly for controllably actuating and deactuating a rocker assembly responsive to a triple-lobed cam in an internal combustion engine between high valve lift and low valve lift modes.

BACKGROUND OF THE INVENTION

Internal combustion engines are well known. In an overhead valve engine, the valves may be actuated directly by camshafts disposed on the head itself, or the camshaft(s) may be disposed within the engine block and may actuate the valves via a valve train which may include valve lifters, pushrods, and rocker arms.

It is known that for a portion of the duty cycle of a typical multiple-cylinder engine, especially at times of low torque demand, valves may be opened to only a low lift position to conserve fuel; and that at times of high torque demand, the valves may be opened wider to a higher lift position to admit more fuel. It is known in the art to accomplish this by providing a special rocker assembly having a switching or latching pin which may be actuated and/or deactuated electromechanically. The rocker assembly includes both fixed peripheral low-lift cam followers that cause low lift of the valve when the pin is disengaged, and a pivotable central high lift cam follower that causes high lift of the valve when the latching pin is engaged into the high lift follower.

Various methods for actuating this type of latching pin are known. For example, see the disclosures of U.S. Pat. Nos. 5,619,958; 5,623,848; and 5,697,333. All of these methods employ individual solenoids, acting through bellcranks or similar structures, as part of an actuation system.

A significant problem for these devices is how to balance the physical size of the solenoid against the force required to actuate the mechanism. The solenoid desirably has rapid response, small size, sufficient stroke and pull-in force, low power requirement, and low sensitivity to voltage and temperature variations; whereas, large size, high pull-in force, and high power are typically required to energize prior art mechanisms.

One approach, disclosed in the above-referenced patents, is to reduce the solenoid force required by using the rotational motion of the rocker assembly inherent in its duty cycle to supply a portion of the actuating force. Typically, the motion of the rocker assembly permits the solenoid to "pull in" to a low air gap wherein high actuating forces can be generated. The solenoid essentially locks itself in the engaged position during a valve lift event (lift portion of the duty cycle), and some other compliant element in the device, such as a bellcrank, resiliently deflects as the rocker returns to the base circle portion of the cam at the conclusion of the lift event. Once the rocker reaches the base circle, the energy stored in the compliant element causes the locking pin to become engaged with the high-lift follower, shifting the rocker assembly to high-lift mode. This configuration requires the holding force of the solenoid in the actuated position to be greater than the force exerted against it by the compliant element; otherwise, the motion of the rocker assembly will overcome the solenoid and increase the magnetic air gap within the solenoid to a point at which the solenoid force becomes too small to actuate the pin, and the rocker then does not shift to high-lift mode.

Another prior art approach, disclosed in U.S. Pat. No. 5,623,897, decouples the force generated by the compliant element from the locking force of the solenoid. One end of the compliant element is "grounded" to the cylinder head, and the solenoid moves the opposite end of the compliant element into a position wherein it may engage the rotational displacement of the rocker assembly. The solenoid simply has to hold the compliant element in that position; it is not required to resist the internal force carried by the compressed compliant element.

The prior art configurations as disclosed have several shortcomings.

First, several of the linkages are fixed with respect to the pivot point of the rocker assembly, which typically is the ball-head of a hydraulic lash adjuster (HLA) supporting the assembly. The vertical length of the HLA may vary in the normal course of operating, and thus the pivot point may also vary in the z (vertical) direction. Further, the vertical and horizontal (x,y) locations of the pivot point must vary inherently from engine to engine as a result of stack-up of manufacturing tolerances. The prior art disclosures do not address practical or self-compensating means for accommodating tolerances in the cylinder head and cam cover.

Second, mechanisms disclosed in the prior art typically employ rotating linkages which may add friction to the force required for actuation and thus increase the force requirements of the solenoid.

Third, none of the disclosed mechanisms, except that shown in U.S. Pat. No. 5,623,897, fully decouples the solenoid force from the compliant element and, therefore, from the pin actuating force. In the disclosure of U.S. Pat. No. 5,623,897, a rotating rocker assembly with a large rocker ratio and large rotational inertia pivots through a relatively large angle in actuating the engine valve. These characteristics add to the force requirements of the solenoid. Further, the solenoid plunger does not act orthogonally to the rocker assembly, resulting in side-loading and friction in the solenoid bearings.

Fourth, in some prior art mechanisms, the point in the rotational cycle of the cam at which the solenoid is energized must be very carefully timed to avoid a phenomenon known in the art as "ejection" wherein the mechanism attempts to engage or disengage the locking pin into or out of the high-lift follower. When the pin is only slightly engaged, it is violently ejected, which can damage the pin or the high-lift follower and which causes a very loud and objectionable noise. Accurate timing of the solenoid energizing can be complex, as the response time of the mechanism may be affected by various operating parameters, such as oil temperature and thus viscosity.

It is a principal object of the present invention to provide an improved variable valve actuation (VVA) assembly wherein a secondary latching mechanism between the solenoid and the primary latching pin in the rocker assembly automatically self-times the engagement of the secondary latching mechanism such that the timing of solenoid energizing and de-energizing is not critical and ejections are prevented.

It is a further object of the invention to provide an improved VVA requiring a low solenoid actuating force and short stroke.

It is a still further object of the invention to provide an improved VVA wherein variation in assembly performance from the stack-up of manufacturing and operating tolerances among the components of the assembly is minimized.

SUMMARY OF THE INVENTION

Briefly described, a variable valve actuation assembly for variably opening of an engine intake valve in either a low-lift or high-lift mode includes a special rocker assembly pivotably disposed in the engine for opening and closing the valve and having a central high-lift cam follower and two peripheral low-lift cam followers, responsive to rotation of a camshaft having low-lift and high-lift lobes engageable with the respective cam followers; a primary latching mechanism including a slidable primary latching pin in the rocker assembly for engaging and disengaging the high-lift follower; a solenoid for causing the primary latching pin to be engaged and disengaged; and a secondary latching mechanism between the solenoid and the primary latching pin to automatically limit engagement and disengagement of the primary latching pin to times in the duty cycle of the camshaft when ejections are not possible.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
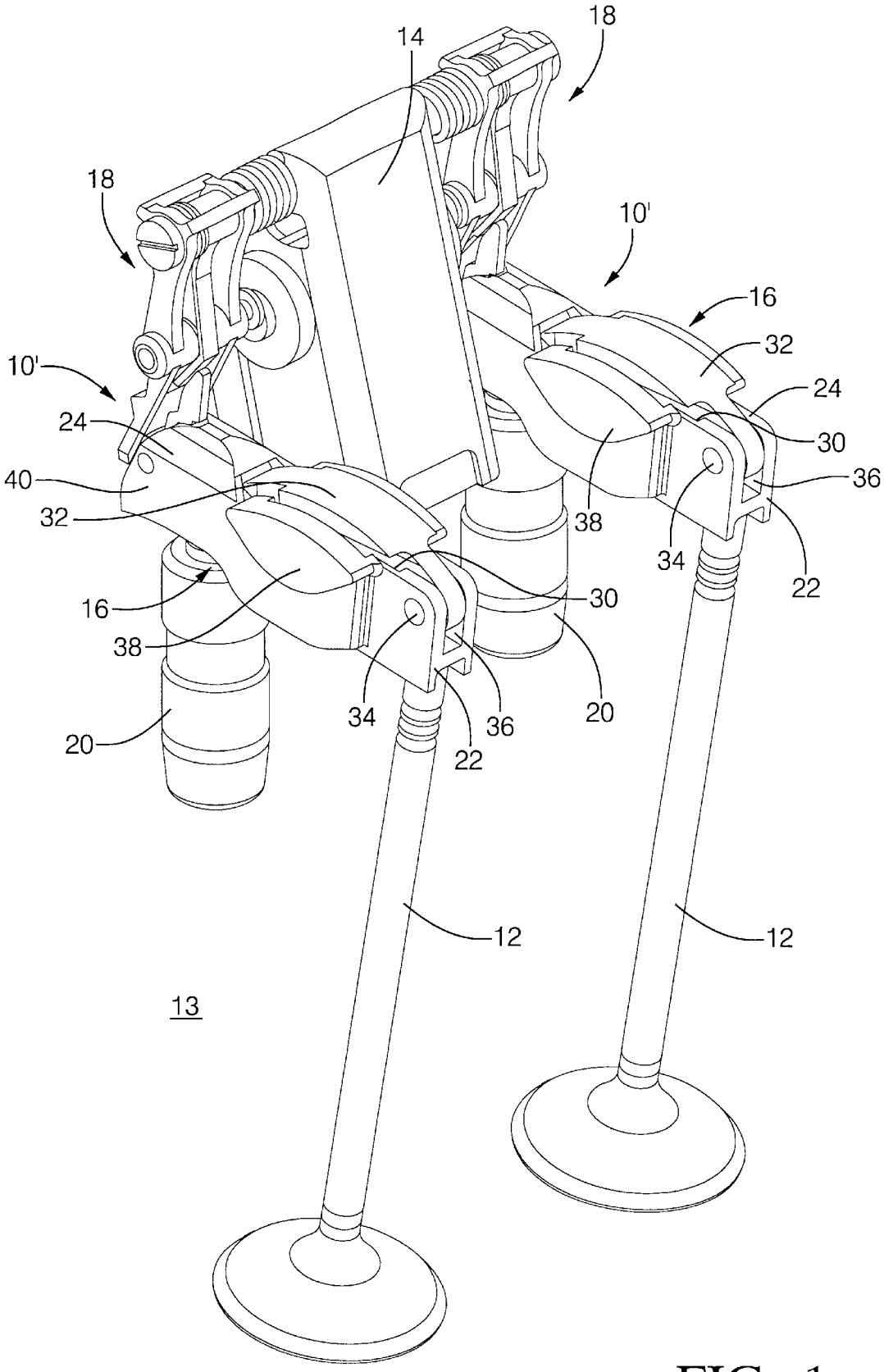
FIG. 1 is an isometric view from above, taken from the camshaft side (camshaft omitted for clarity) showing two variable valve actuation assemblies in accordance with the invention configured for operation of adjacent intake valves of adjacent engine cylinders.
Figure 2:
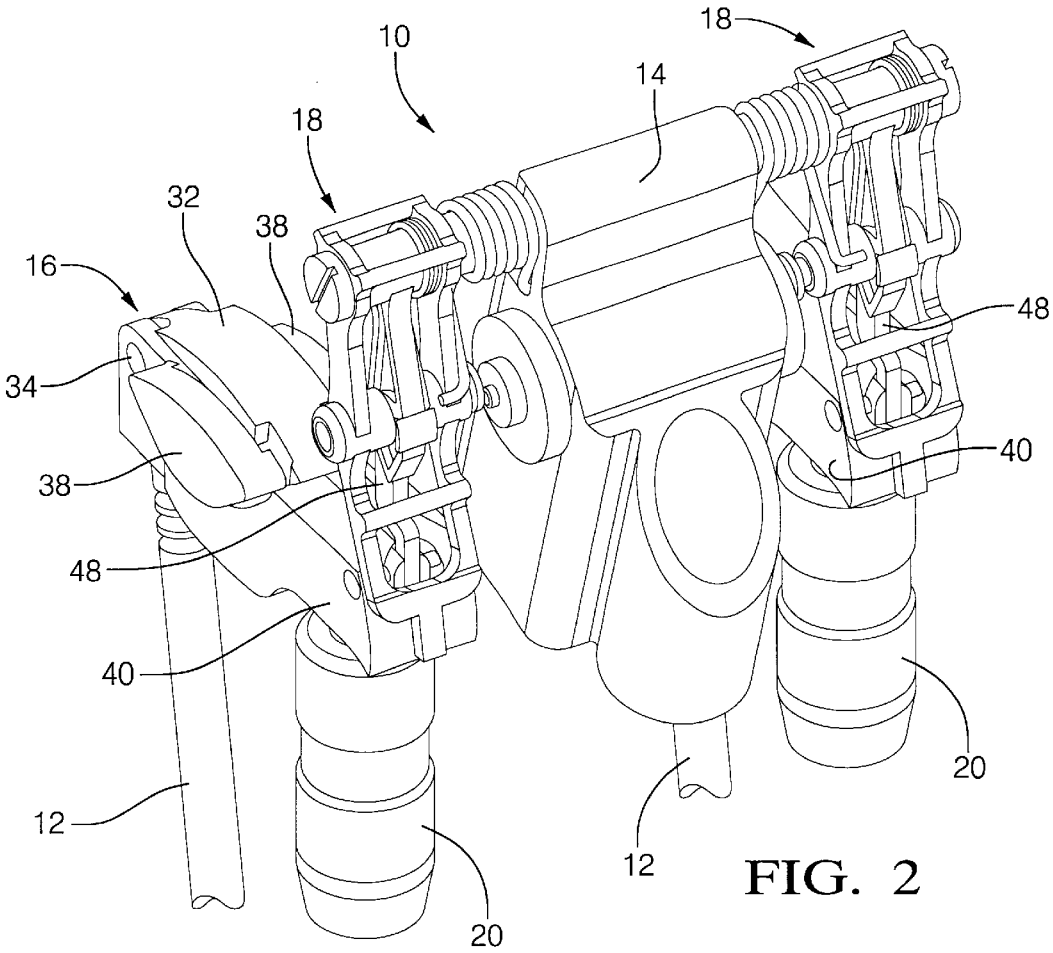
FIG. 2 is an isometric view from above of the VVA assemblies shown in FIG. 1, taken from opposite the camshaft side (camshaft omitted for clarity)
Figure 3:
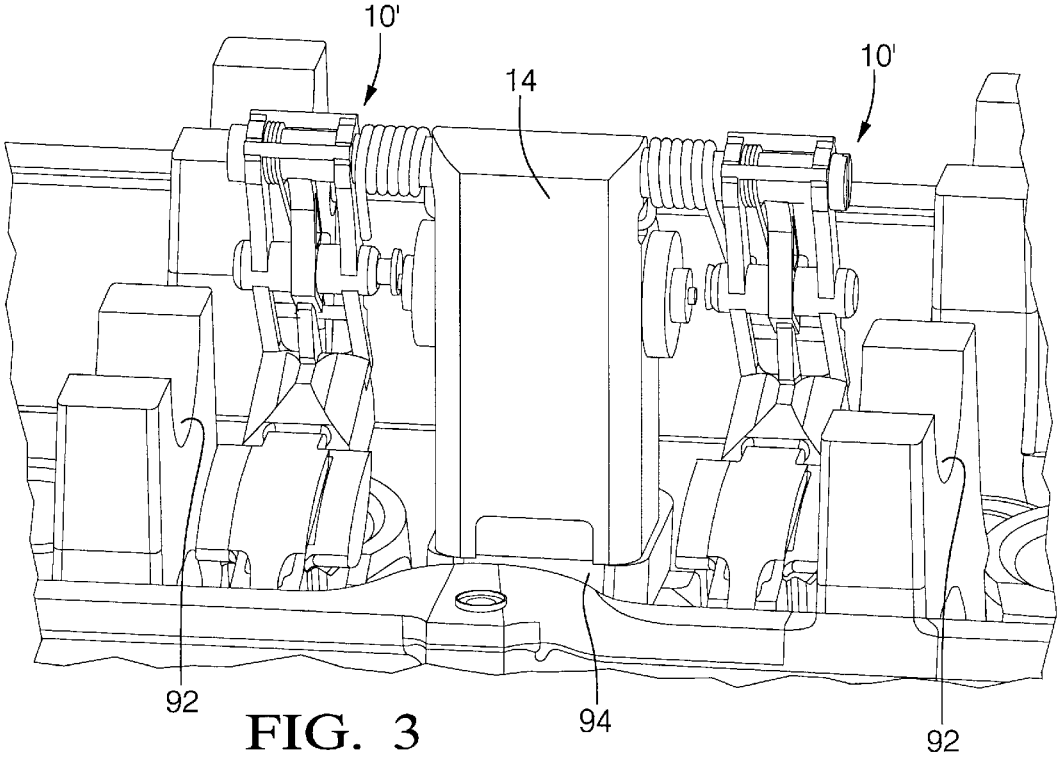
FIG. 3 is an isometric view similar to that shown in FIG. 1, showing the VVA assemblies installed in the head of an engine.

Referring to FIGS. 1 and 2, an improved dual variable valve actuation (VVA) assembly 10 in accordance with the invention is shown for variable actuation of two separate valves 12 of internal combustion engine 13. Assembly 10 includes two separate, substantially identical VVA mechanisms 10' sharing a common arbor 14 mountable onto an engine head 94 (as shown in FIG. 3). As the two VVA assemblies are substantially mirror images of each other, the following discussion is directed to only one VVA but should be understood as being applicable to both except as noted. Each mechanism 10' includes a rocker assembly 16 and a secondary latching assembly 18. Rocker assembly 16 is pivotably mounted, preferably by a ball-and-socket joint, on a conventional hydraulic lash adjuster (HLA) 20 and is pivotably connected near a distal end 22, to the stem of a valve 12.

Referring to FIGS. 1 and 2 and any of FIGS. 7 through 10, rocker assembly 16 is similar to two-stage rocker assemblies known in the art, as described above. A frame 24 has a spherical socket 26 for pivotably mating with the ball head 28 of HLA 20. Frame 24 provides a rigid but pivotable bridge between HLA 20 and valve 12, and is formed having a generally rectangular longitudinal aperture 30 for receiving a high-lift cam follower 32 having a surface for following a high-lift cam lobe as described below. Follower 32 is pivotably pinned at one end by pin 34 in slot 36 formed in frame 24 in communication with aperture 30. Preferably, a first torsion spring (not shown) is disposed on pin 34 in slot 36 to bias follower 32 upwards into continual contact with its respective cam lobe. Frame 24 further is provided with two rigidly-mounted low-lift cam followers 38, each having a surface for following a low-lift cam lobe as described below.

Figure 10:
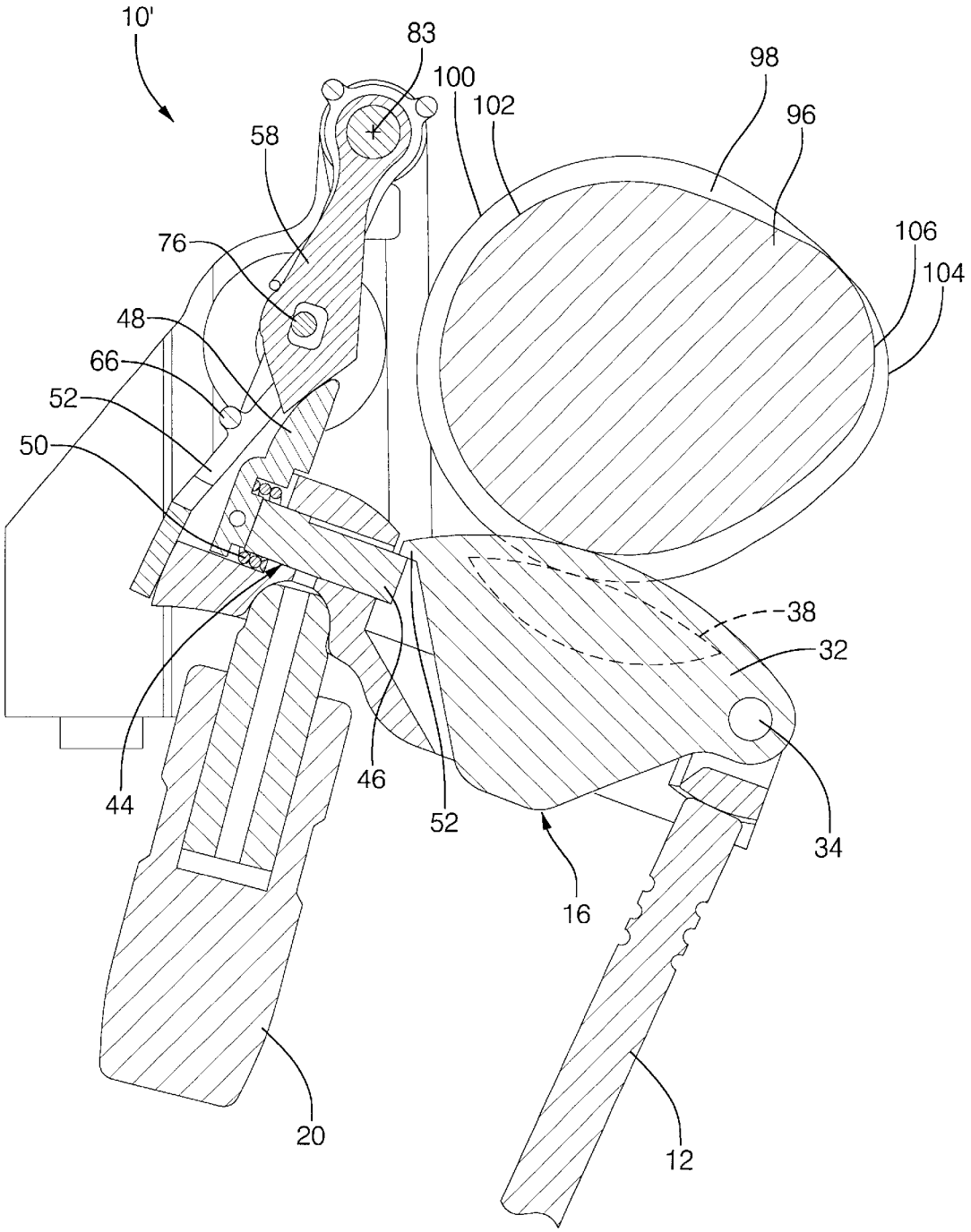

At the proximal end 40 of rocker assembly 16, a primary latching assembly 17 in frame 24 includes a stepped bore 42 slidably receivable of a primary latching pin 44 comprising a latching portion 46 and a trigger portion 48. Pin 44 is urged away from high-lift follower 32 by a compression spring 50 disposed in bore 42 between frame 24 and trigger portion 48. When follower 32 is suitably positioned (as shown in FIG. 10), portion 46 may be moved axially of bore 42 to engage portion 46 under latching nose 52 of follower 32, thereby preventing follower 32 from rotating about pin 34, and transforming rocker assembly 16 into high-lift mode, as described below.

Figure 5:
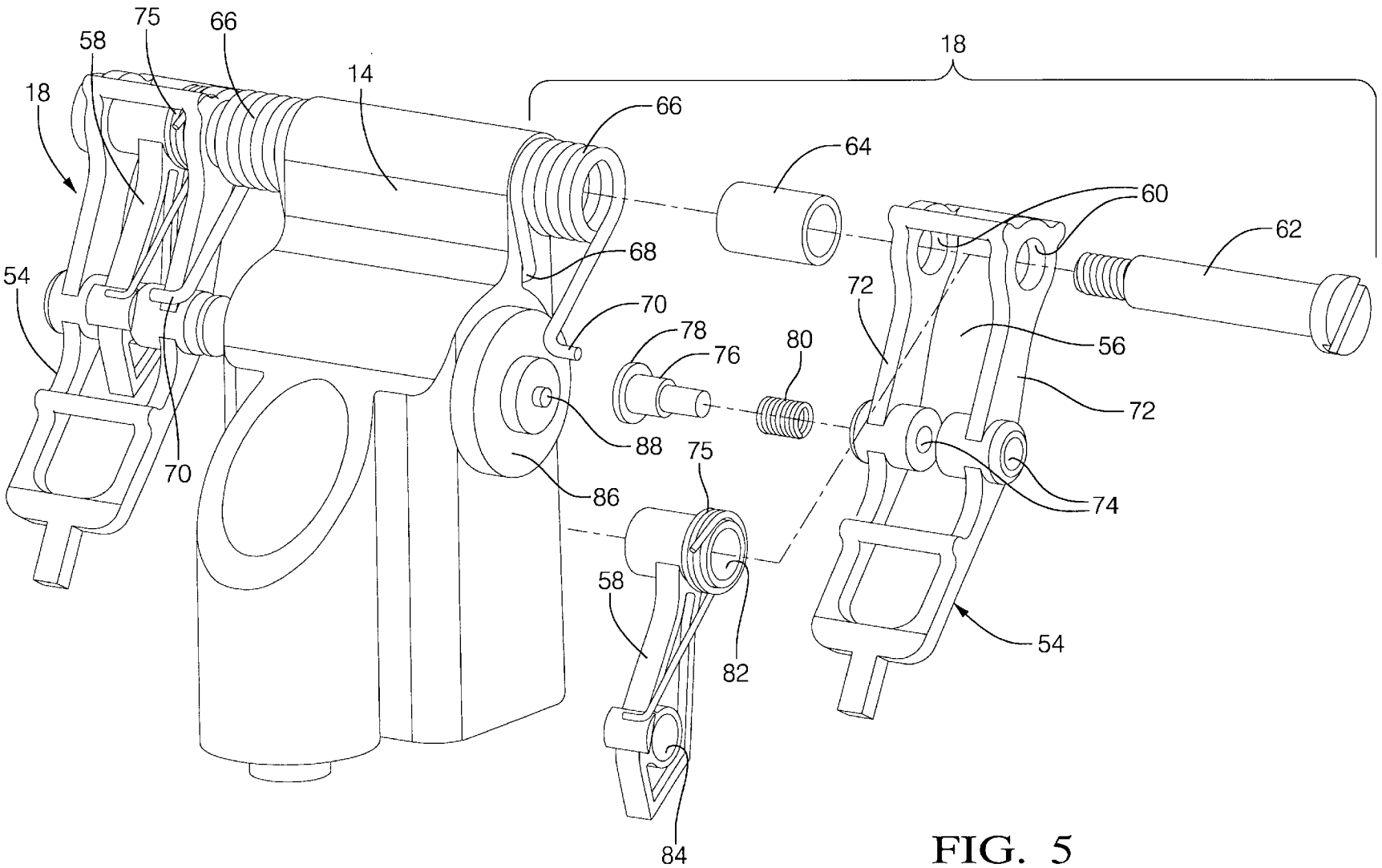
FIG. 5 is an isometric view, partially exploded, taken from the VVA side opposite the camshaft side, of secondary latching mechanisms in the VVA assemblies shown in FIGS. 1–4.
Figure 6:
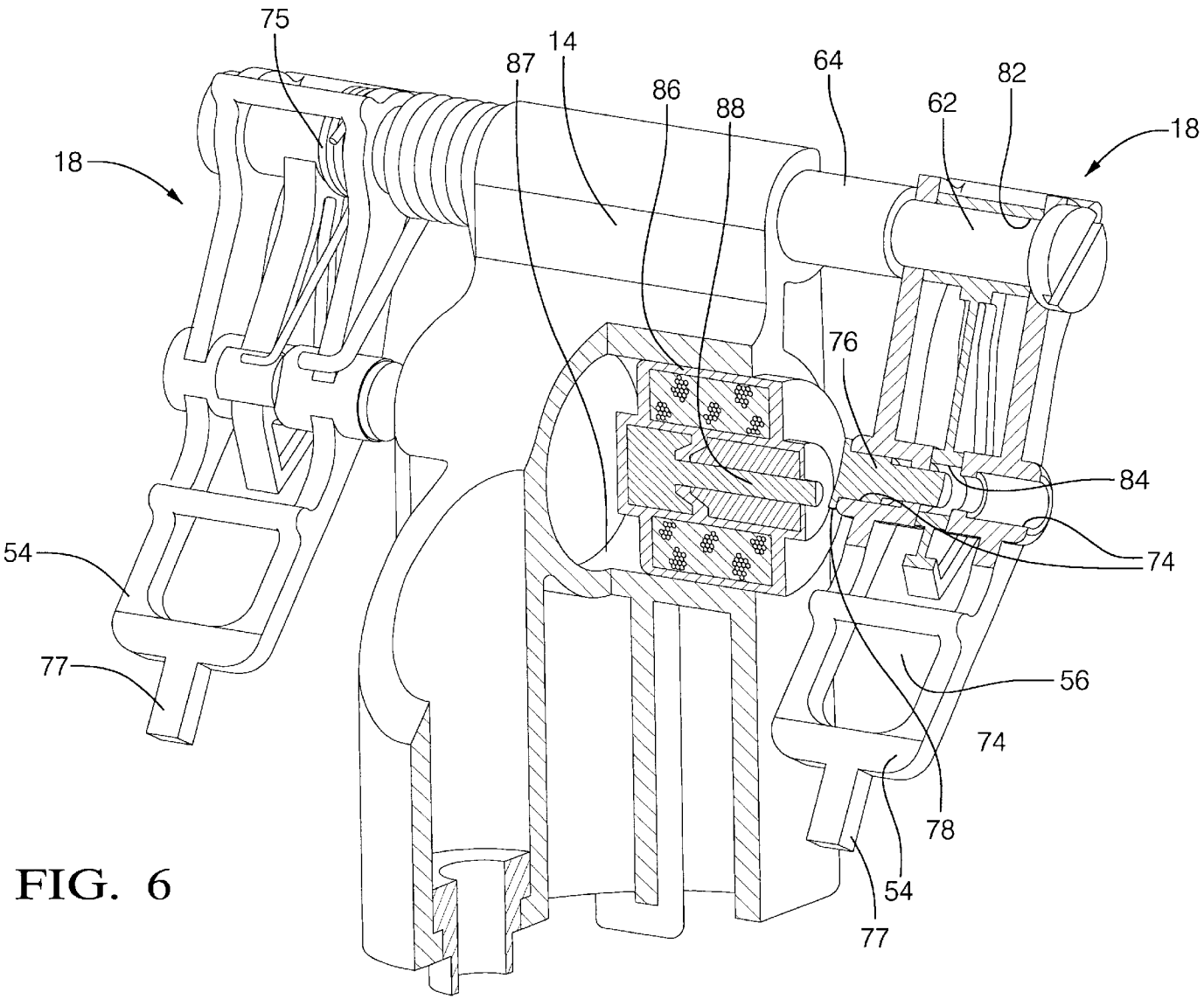
FIG. 6 is an isometric view, partially in cross-section, similar to that shown in FIG. 5, showing the relationship of the solenoid mounted on an arbor on the engine and a secondary latching pin in the secondary latching mechanisms shown in FIG. 5.
Figure 7:
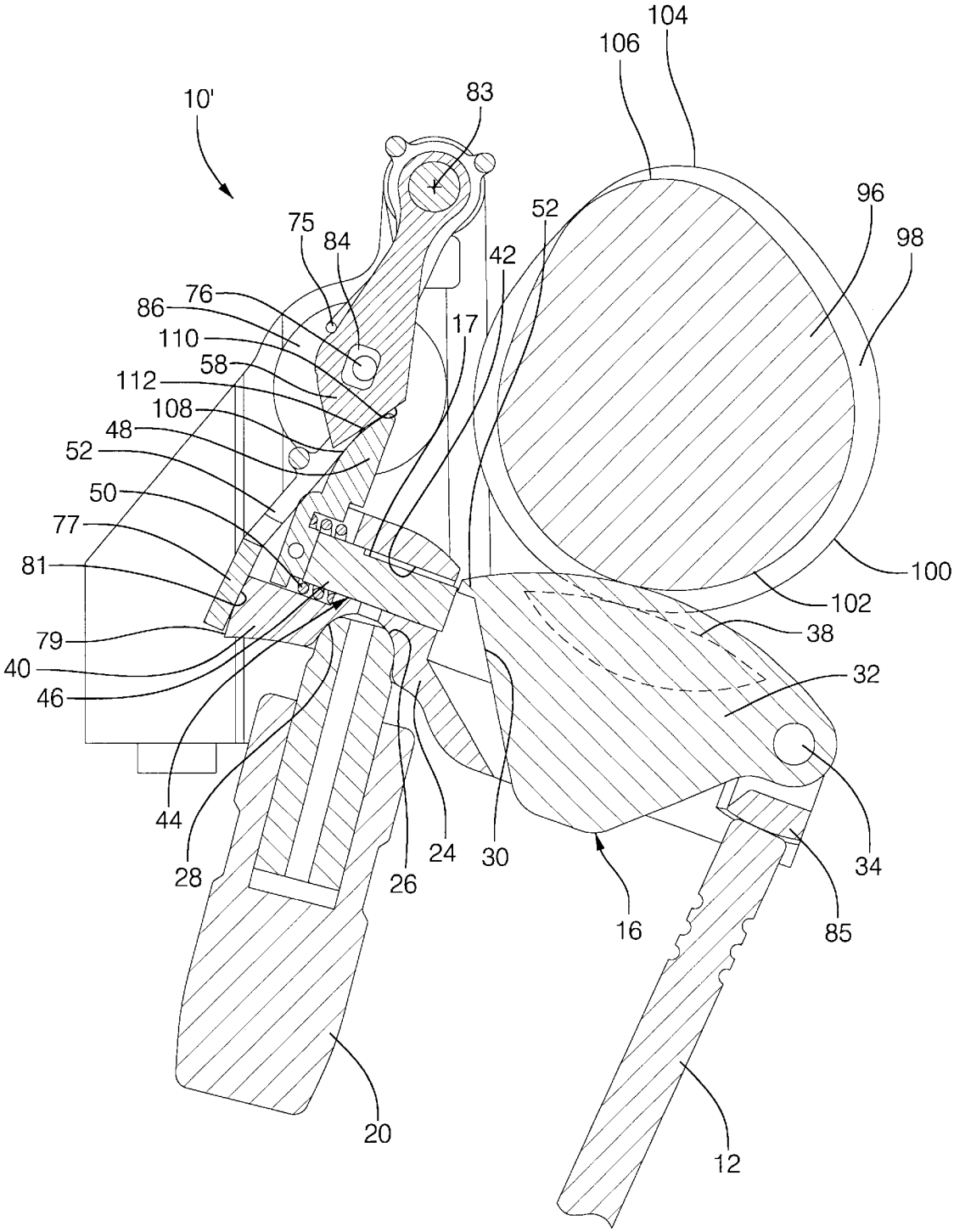
FIGS. 7 through 10 are cross-sectional elevational views through a VVA taken along plane 7–10 in FIG. 4, showing successive stages in one operating cycle of a VVA in accordance with the invention.

Referring to FIGS. 5 through 10, secondary latching assembly 18 includes a backer frame 54 having a central aperture 56 for receiving a blocker plate 58 therein. Backer frame 54 is provided with bores 60 for receiving pivot screw 62 which is threadedly received in a bore in arbor 14 to pivotably attach frame 54 to arbor 14. A shim 64 on screw 62 spaces frame 54 a predetermined distance from arbor 14 and supports a second torsion spring 66 engaged by a first tang 68 into arbor 14 and by a second tang 70 onto frame 54 for urging frame 54 pivotably toward rocker assembly 16. As shown in FIGS. 5 and 6, each siderail 72 of frame 54 is further provided with a stepped bore 74 for receiving a stepped secondary latching pin 76 having a flat boss 78 at one end thereof. A compression spring 80 is disposed in bore 74 around pin 76 for urging pin 76 outwards of bore 74. Only one bore 74 is used for each frame 54, but preferably the two bores 74 provided in each frame are mirror images of each other so that a single configuration of frame 54 may be used for either of the assemblies 18 shown in these figures.

Blocker plate 58 is provided with a first bore 82 at an end thereof for receiving screw 62 to pivotably mount plate 58 between bores 60 in frame 54 such that plate 58 can swing through aperture 56. A third torsion spring 75 is disposed on screw 62 coaxially with plate 58 and is configured conventionally to urge plate 58 rotationally of screw 62 against trigger portion 48. Plate 58 is further provided with a medial bore 84 for receiving secondary latching pin 76 to rotationally lock plate 58 to frame 54 when so desired.

Frame 54 is further provided with an actuating extension 77 for engaging with the bearing surface 79 of rocker proximal end 40. Preferably, the bearing surface 81 of extension 77 is included in a plane including the pivot axis 83 of backer frame 54 and bearing surface 79 is a cylindrical arc centered on the center of arcuate pad 85 which interfaces with the stem of valve 12. As rocker assembly 16 oscillates about HLA head 28 during actuation thereof, surface 79 rotates and slides along surface 81 at a constant radius, and therefore the position of backer frame 54 is unaffected by such action. Further, these geometric relationships make the VVA mechanism virtually insensitive to normal manufacturing, assembly, and operating variations in the size and position of these components.

Arbor 14 is provided with a well 87 for receiving a solenoid 86 having an armature plunger 88 extending toward boss 78 on pin 76 in a direction orthogonal to plane 7–10 (FIG. 4), which is the actuation plane of assembly 10', and parallel to the axis of rotation of the camshaft. When solenoid 86 is energized, pin 76 is urged toward blocker plate 58 in attempt to enter into bore 84 to lock plate 58 to frame 54. Such entry is permitted under conditions as described below, wherein bore 74 becomes axially aligned with bore 84. Where entry is not permitted immediately upon energizing of the solenoid, the energized solenoid acts as a cocked electromechanical spring and will insert pin 76 into bore 84 at the earliest opportunity during the camshaft duty cycle, as described below.

Figure 4:
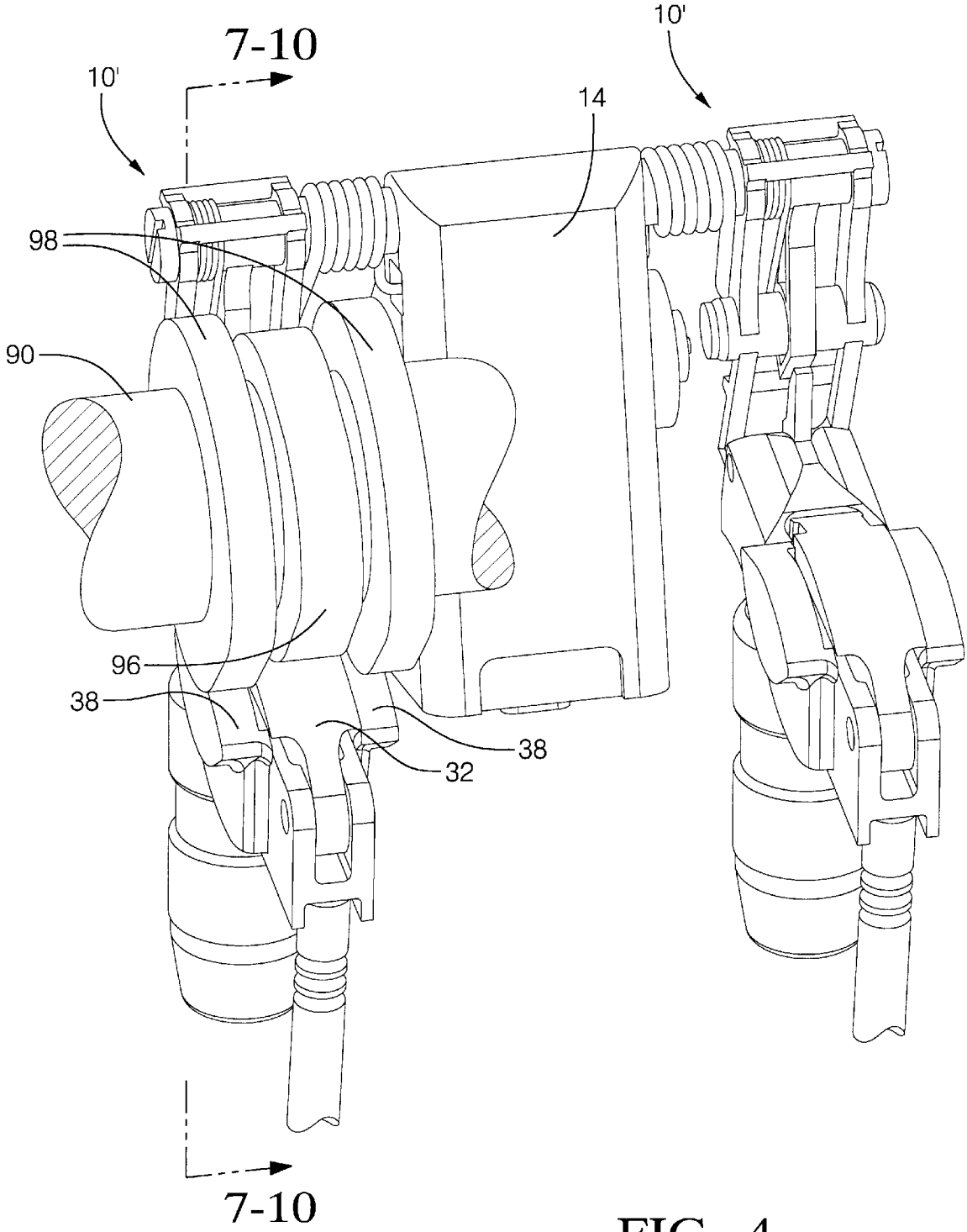
FIG. 4 is a view similar to that shown in FIG. 1, but including a camshaft with high-lift and low-lift cams for one of the VVA assemblies.

Referring to FIGS. 3 and 4, a camshaft 90 is carried in bearing mounts 92 formed in engine head 94 which positions cam lobes for actuation of valves 12 via rocker assembly 16. In FIG. 4, the camshaft and cam lobes are shown for only one valve, but it should be understood that identical lobes are provided for each valve having an associated VVA mechanism. Camshaft 90 is provided with a central high-lift lobe 96, which is followed by central high-lift follower 32, and a pair of identical peripheral low-lift lobes 98 flanking lobe 96, which are followed by peripheral low-lift followers 38.

The conversion of a VVA assembly 10' from low-lift mode (default mode) to high-lift mode is shown sequentially in FIGS. 7 through 10. Beginning with FIG. 7, in default low-lift mode, primary latching pin 44 is disengaged from high-lift follower 32. Valve 12 is closed. Low-lift cam lobe 98 is engaged on its base circle portion 100 with low-lift follower 38, and high-lift cam lobe 96 is engaged on its base circle portion 102 with high-lift follower 32. Solenoid 86 is de-energized and therefore secondary latching pin 76 is disengaged from blocker plate 58 which is pivoted out of alignment by contact with trigger portion 48 at contact point 112. Thus compression spring 50 which urges primary latching pin 44 out of engagement must be stronger than, and overcome, third torsion spring 75. To begin the change from low-lift mode to high lift mode, solenoid 86 may be energized at any time during the camshaft duty cycle. Plunger 88 of the solenoid forcibly engages boss 78 (not visible in FIGS. 7–10) but secondary latching pin 76 cannot yet enter bore 84 because of axial misalignment. Secondary latching pin 76 is thus cocked by the energized solenoid to enter bore 84 in the blocker plate to lock the blocker plate to the backer frame 54 as soon as bore 84 becomes coaxially aligned with the pin.

Figure 8:
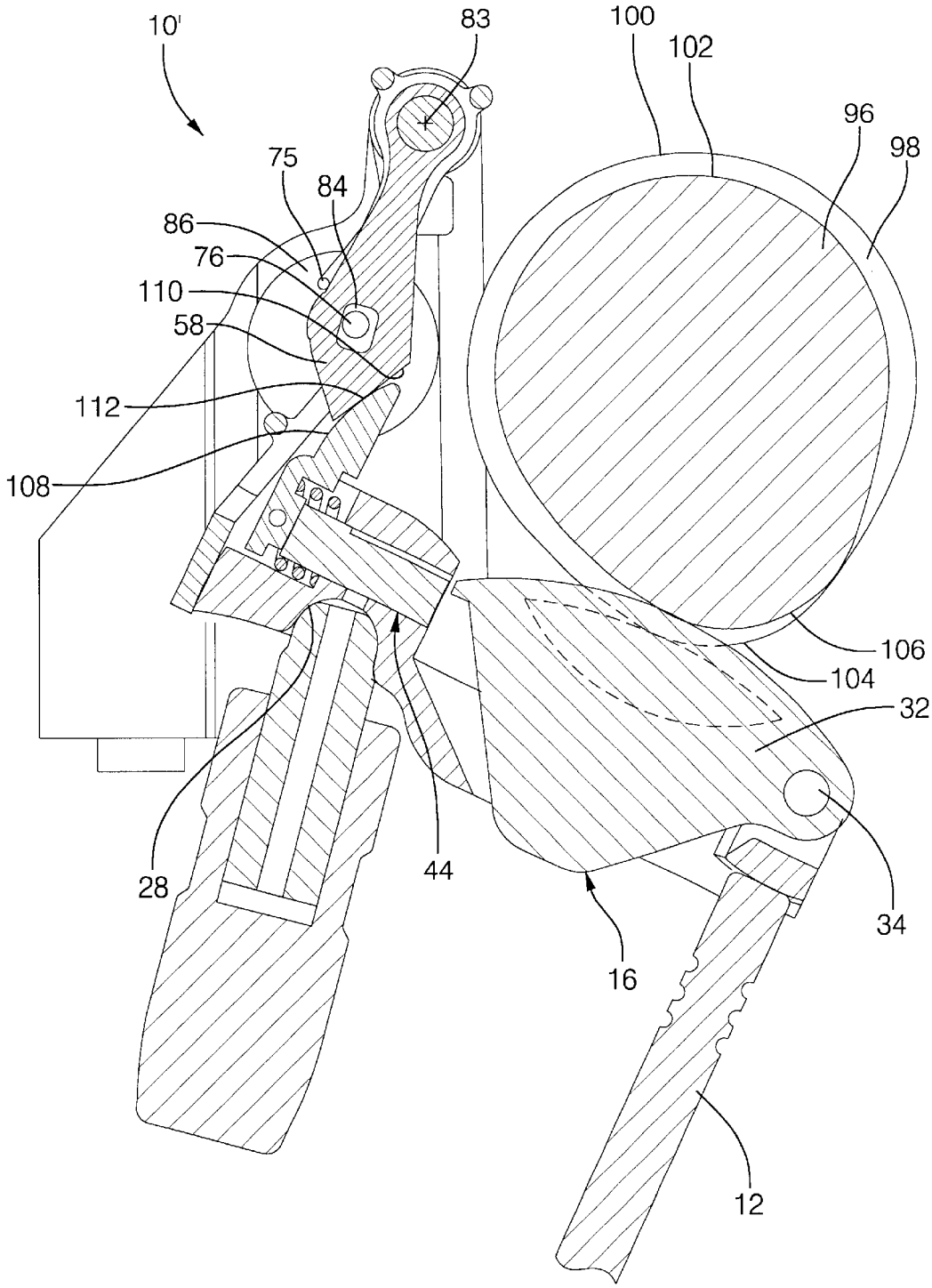

Referring to FIG. 8, a low-lift event is shown in progress. The camshaft has rotated the cam lobes counterclockwise such that eccentric portion 104 of low-lift lobe 98 is engaged with low-lift follower 38, thereby rotating rocker assembly 16 clockwise about HLA head 28 and opening valve 12 with low lift. Eccentric portion 106 of high-lift lobe 96 is similarly engaged with high-lift follower 32, but because follower 32 is disengaged from primary latching pin 44 the follower simply pivots on pin 34 without lift effect on valve 12. Note that bearing surface 108 on trigger 48 is preferably cylindrically arcuate and bearing surface 110 on blocker plate 58 is preferably flat. Comparing the contact point 112 between these two surfaces in FIG. 7 and FIG. 8, it is seen that the surface 108 moves along surface 110 in a combination sliding and rolling motion in response to the clockwise rotation of rocker assembly 16. The angle of surface 110 with respect to pivot point 83 is such that the relationship of blocker plate 58 to backer frame 54 does not vary with tolerance variations in the cylinder head, an importance advance in the art conferred by an assembly in accordance with the invention. Further, because the change in contact point between the bearing surfaces is eccentric with respect to the pivot point of the rocker assembly, blocker plate 58 is permitted to pivot counterclockwise slightly about pivot axis 83, bring bore 84 into alignment with pin 76, which then enters bore 84 at the urging of the previously energized solenoid. Because the pin is small and of low mass, and because bore 84 is aligned with pin 76 by the natural motion of rocker assembly 16 imparted by the engine, solenoid 86 may be very small and relatively weak, thus overcoming the disadvantages of prior art VVA mechanisms as described above. This is an important advantage of a VVA assembly in accordance with the invention.

Figure 9:
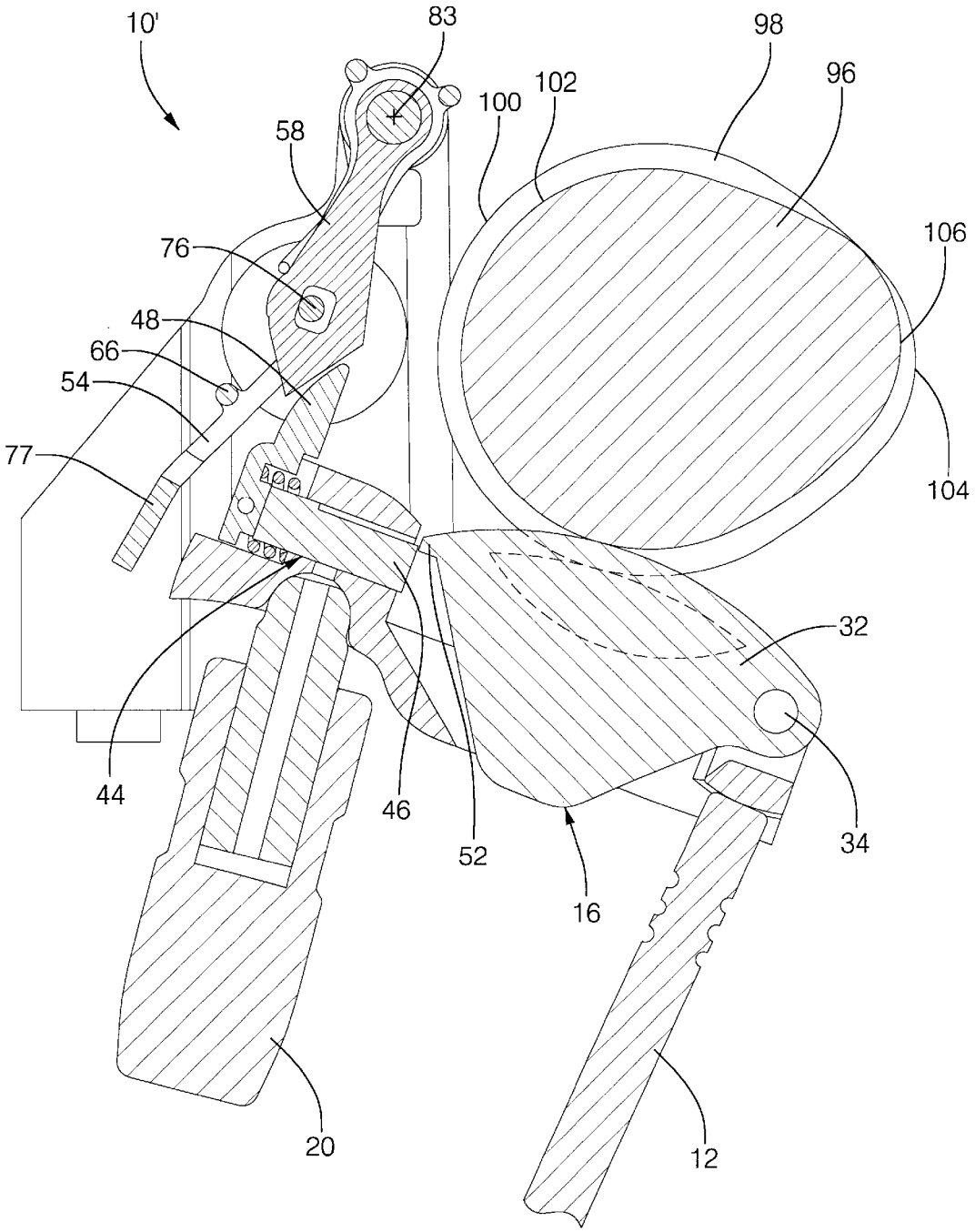

Referring to FIG. 9, as the low-lift event progresses, the cam lobes have rotated further counterclockwise such that the followers are in contact with the lobes at the point of merger between the eccentric portions 104,106 and the base circle portions 100,102 of the lobes 98,96. Valve 12 has been closed by the action of a conventional valve spring (not shown), causing rocker assembly 16 to rotate counterclockwise back to its rest position, as shown previously in FIG. 7. However, blocker plate 58 is not free to also return to its former position because it is now locked to backer frame 54, as was seen in FIG. 8. Further, latching portion 46 of primary latching pin 44 is still in slight interference with latching nose 52. Therefore, the locked unit of backer frame and blocker plate is pivoted clockwise about axis 83 against second torsion spring 66, cocking the primary and secondary latching mechanisms for engagement of primary latching pin 44 with latching nose 52 at the earliest opportunity.

Referring to FIG. 10, the low-lift event is completed and rocker assembly 16 is locked in high-lift mode by primary locking pin 44. The cam lobes have rotated slightly farther than as shown in FIG. 9, onto their respective base circle portions, and high-lift follower 32 has pivoted farther clockwise about pivot pin 34, bringing latching nose 52 into latching alignment with latching portion 46. Second torsion spring 66 is stronger than compression spring 50 and immediately urges primary latching pin 44 into engagement with latching nose 52, compressing spring 50 and completing the conversion of the rocker assembly from low-lift mode to high-lift mode. During the next revolution of the camshaft, the high-lift eccentric of lobe 96 will cause rocker assembly 16 to rotate through a greater angle than in the previous duty cycle, thereby opening valve 12 wider (higher lift) than in its previous opening.

Both primary latching pin 44 and secondary latching pin 76 will remain engaged as long as solenoid 86 is energized; the assembly will thus remain in high-lift mode. To shift back to low-lift (default) mode, the solenoid may be de-energized at any point. It will be seen that there is no shear force on secondary pin 76 while either a low-lift or high-lift event is in progress (eccentric lobe portions are engaged). Thus pin 76 is free to engage or disengage with bore 84 at any such time. De-energizing the solenoid during the high-lift event permits compression spring 80 to eject pin 76 from bore 84; however, primary latching pin 44 remains engaged with latching nose 52 because of shear force therebetween. When the lobes return to their base circles and such shear force is removed, compressed spring 50 immediately urges primary latching pin out of engagement with nose 52. Blocker plate 85 is free to pivot away, and the assembly is returned to the default low-lift mode shown in FIG. 7.

It is an important advantage of a VVA assembly in accordance with the invention that the engagement of the primary latching pin with the high-lift follower necessarily occurs at the beginning of the base circle lobe engagement, at a point of no shear force between the pin and the follower. Thus, ejections of the primary latching pin, as are well known in the prior art, are rendered impossible. Further, because the secondary latching pin engages the blocker arm only when they are axially aligned, which occurs only during the lift portion of a low-lift duty cycle, the solenoid need be only strong enough to displace the secondary pin axially a short distance.

Figure 11:
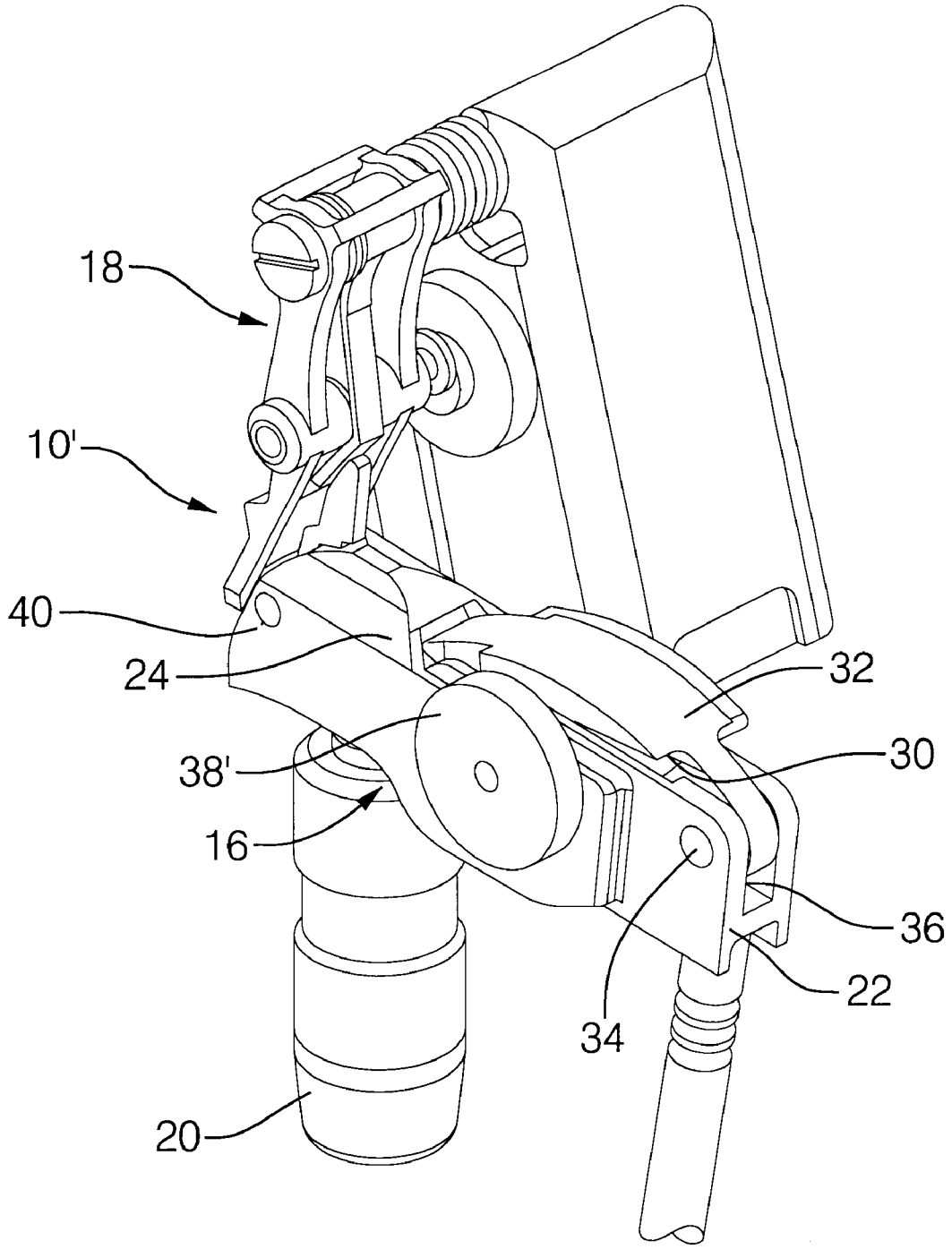
FIG. 11 is another view of FIG. 1 showing cam follower rollers as an alternate embodiment.

While the invention has been described by reference to various specific embodiments, it should be understood that numerous changes may be made within the spirit and scope of the inventive concepts described. For example, high-lift and low-lift cam followers 32,38 are shown as sliders herein but some or all of the followers may instead be provided as rollers rotatably mounted to frame 24 within the scope of the invention. For example, in FIG. 11, roller 38' is shown instead of slider 38. Accordingly, it is intended that the invention not be limited to the described embodiments, but will have full scope defined by the language of the following claims.

What is claimed is:

1. A variable valve actuation (VVA) assembly for actuation and deactuation of valves in an internal combustion engine having a camshaft with high-lift and low-lift lobes for at least one of said valves, each of said lobes having a lift portion and a base circle portion, the camshaft having an axis of rotation, comprising:

a) a rocker assembly pivotably disposed on pivot means in said engine for variably responding to rotary motion of said lobes to open and close a valve of said engine, said rocker assembly including a frame fixedly supportive of at least one low-lift cam follower and pivotably supportive of a variably pivotable high-lift cam follower, said follower being pivotable about a first pivot axis;

b) a primary latching assembly and a secondary latching assembly, said primary latching assembly disposed on said rocker assembly for variably latching said high-lift cam follower to said frame, said primary latching assembly including a primary latching pin slidingly disposed in a bore in said frame and variably engageable with said high-lift cam follower, said primary latching pin having a trigger portion for engaging with said secondary latching assembly, a first spring operatively connected to said primary latching pin for urging said pin out of engagement with said high-lift follower, said secondary latching assembly adjacent said primary latching assembly for variably actuating said primary latching assembly; and c) a solenoid adjacent said secondary latching assembly for variably actuating said secondary latching assembly.

2. A VVA assembly in accordance with claim 1 further comprising an arbor mountable to said engine, wherein said secondary latching assembly comprises:

a) a backer frame pivotably mounted to said arbor for pivoting about a second pivot axis for variable contact with said rocker assembly;

b) secondary latching means disposed on said backer frame; and c) a blocker plate pivotably mounted to said arbor for pivoting about said second pivot axis and having a bore variably receivable of said secondary latching means for locking said backer frame and said blocker plate together for unified pivoting.

3. A VVA assembly in accordance with claim 2 wherein said solenoid is disposed on said arbor for variably actuating said secondary latching means.

4. A VVA assembly in accordance with claim 3 wherein said solenoid has an axis of linear actuation, and wherein said axis is parallel to said axis of rotation of said camshaft.

5. A VVA assembly in accordance with claim 2, said trigger portion having a first bearing surface for engaging said blocker plate and said blocker plate having a second bearing surface for engaging said trigger portion, wherein said first bearing surface is arcuate and said second bearing surface is planar.

6. A VVA assembly in accordance with claim 2 wherein said backer frame further comprises an actuating extension for variably engaging said rocker assembly.

7. A VVA assembly in accordance with claim 6 wherein said actuating extension has a first surface for engaging said rocker assembly, and wherein said first surface is planar and is included in a plane including said second pivot axis.

8. A VVA assembly in accordance with claim 6 wherein said rocker assembly has a bearing surface for engaging said first surface of said actuation extension, and wherein said assembly bearing surface is arcuate.

9. A VVA assembly in accordance with claim 2 wherein said pivoting of said rocker assembly in response to motion of said eccentric portion of said low-lift cam lobe causes said primary latching assembly to pivot said blocker plate about said second pivot axis such that said secondary latching means can enter said bore in said blocker plate to lock said blocker plate to said backer frame.

10. A VVA assembly in accordance with claim 2 wherein said primary latching pin is engageable of said high-lift follower only while said at least one low-lift follower is being engaged by said base circle portion of said low-lift cam lobe.

11. A VVA assembly in accordance with claim 2 further comprising:

a) a second spring disposed between said backer frame and said arbor for urging said backer frame toward said rocker assembly; and b) a third spring disposed between said blocker plate and said backer frame for urging said blocker plate toward said trigger portion.

12. A VVA assembly in accordance with claim 11 wherein said first spring is stronger than said third spring, and wherein said second spring is stronger than either of said first and third springs.

13. A VVA assembly in accordance with claim 1 wherein at least one of said high-lift and low-lift followers includes a roller rotatably disposed on said frame.

14. A variable valve actuation (VVA) assembly for actuation and deactuation of first and second valves in an internal combustion engine having a camshaft with high-lift and low-lift lobes for each one of said valves, each of said lobes having a lift portion and a base circle portion, the camshaft having an axis of rotation, comprising:

a) an arbor mounted on said engine;

b) first and second rocker assemblies pivotably disposed on first and second pivot means in said engine for variably responding to rotary motion of said lobes to open and close said first and second valves, respectively, each of said rocker assemblies including a frame fixedly supportive of at least one low-lift cam follower and pivotably supportive of a variably pivotable high-lift cam follower, said follower being pivotable about a first pivot axis;

c) first and second primary latching assemblies disposed on said first and second rocker assemblies, respectively, for variably latching said high-lift cam followers to said frames;

d) first and second secondary latching assemblies for variably actuating said first and second primary latching assemblies, respectively; and e) first and second solenoids disposed on said arbor for variably actuating said first and second secondary latching assemblies, respectively.

15. A secondary latching assembly mountable to an internal combustion engine for actuating a primary latching means in a rocker assembly for variably actuating a valve in the engine, comprising:

a) a backer frame pivotably mounted to said engine for pivoting about a second pivot axis for variable contact with said rocker assembly;

b) secondary latching means disposed on said backer frame; and d) a blocker plate pivotably mounted to said engine for pivoting about said second pivot axis and having a bore variably receivable of said secondary latching means for locking said backer frame and said blocker plate together for unified pivoting.

16. A secondary latching assembly in accordance with claim 15 further comprising a solenoid disposed on said arbor for variably actuating said secondary latching means.

17. A secondary latching assembly in accordance with claim 16 further comprising an actuating extension for engaging said rocker assembly, said actuating extension having a first surface for engaging said rocker assembly, wherein said first surface is planar and is included in a plane including said second pivot axis.

18. An internal combustion engine having a variable valve actuation assembly for variable actuation of an engine valve, comprising:

a) a rocker assembly pivotably disposed on pivot means in said engine for variably responding to rotary motion of camshaft lobes to open and close on at least one valve of said engine, said rocker assembly including a frame fixedly supportive of at least one low-lift cam follower and pivotably supportive of a variably pivotable high-lift cam follower, said follower being pivotable about a first pivot axis;

b) a primary latching assembly and a secondary latching assembly, said primary latching assembly disposed on said rocker assembly for variably latching said high-lift cam follower to said frame, said primary latching assembly including a primary latching pin slidingly disposed in a bore in said frame and variably engageable with said high-lift cam follower, said primary latching pin having a trigger portion for engaging with said secondary latching assembly, a first spring operatively connected to said primary latching pin for urging said pin out of engagement with said high-lift follower, said secondary latching assembly adjacent said primary latching assembly for variably actuating said primary latching assembly; and c) a solenoid adjacent said secondary latching assembly for variably actuating said secondary latching assembly.

* * * * *